US005631440A

United States Patent [19]

Thureson et al.

[11] Patent Number: 5,631,440

[45] Date of Patent: May 20, 1997

[54] UNIVERSAL ISOLATION MEMBER AND NON-ELECTRIC DETONATOR CAP INCLUDING THE SAME

[75] Inventors: Gary R. Thureson, Avon; Eric R. Davis, Torrington; Ernest L. Gladden, Granby; Alvaro Zappalorti, Avon, all of Conn.

[73] Assignee: The Ensign-Bickford Company, Simsbury, Conn.

[21] Appl. No.: 606,224

[22] Filed: Feb. 23, 1996

Related U.S. Application Data

[63] Continuation of Ser. No. 327,200, Oct. 21, 1994, abandoned.

[51] Int. Cl.[6] ..... C06C 5/06

[52] U.S. Cl. ..... 102/275.7; 102/275.2; 102/275.12

[58] Field of Search ..... 102/275.2, 275.3, 102/275.4, 275.5, 275.6, 275.7, 275.12

[56] References Cited

U.S. PATENT DOCUMENTS

| | | | |
|---|---|---|---|
| 3,981,240 | 9/1976 | Gladden . | |
| 4,335,652 | 6/1982 | Bryan | 102/275.3 |
| 5,031,538 | 7/1991 | Dufrane et al. | 102/275.5 |
| 5,365,851 | 11/1994 | Shaw | 102/275.6 |

FOREIGN PATENT DOCUMENTS 1046812 1/1979 Canada .

OTHER PUBLICATIONS

Drawing 92C 34D of The Ensign–Bickford Company.
Drawing No. 92C 349D of The Ensign–Bickford Company.

*Primary Examiner*—Michael J. Carone
*Assistant Examiner*—Theresa M. Wesson
*Attorney, Agent, or Firm*—Victor E. Libert; Frederick A. Spaeth; David T. Shoneman

[57] ABSTRACT

An isolation member (34) for use in a non-electric detonator cap (10) has an interior passageway (40) extending therethrough and defining a positioning region (44) and a discharge port (56). Positioning region (44) provides a series of interior shoulders (46), (48) and an entry shoulder (52) respectively sized to receive and seat therein signal transmission lines of different outside diameters, thereby longitudinally orienting and spacing the signal-emitting end (30*a*) from the receptor charge (14). The isolation member (34) is preferably made of a semi-conductive material to bleed off to the shell (12) any static electricity charges transmitted through the signal transmission line (shock tube 30) so as to prevent static discharge initiation of the receptor charge (14).

22 Claims, 4 Drawing Sheets

FIG. 2A
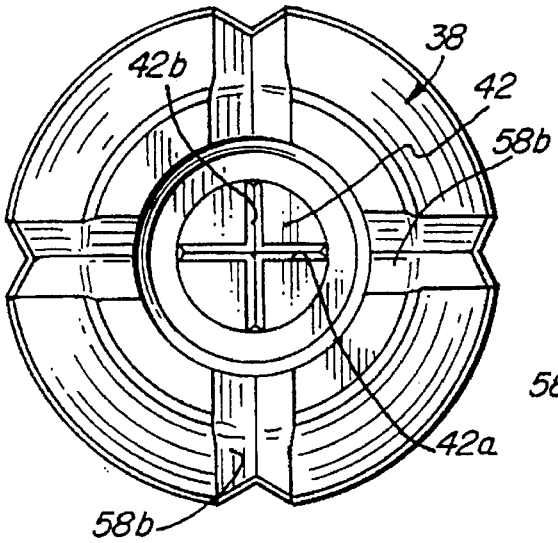
FIG. 2B
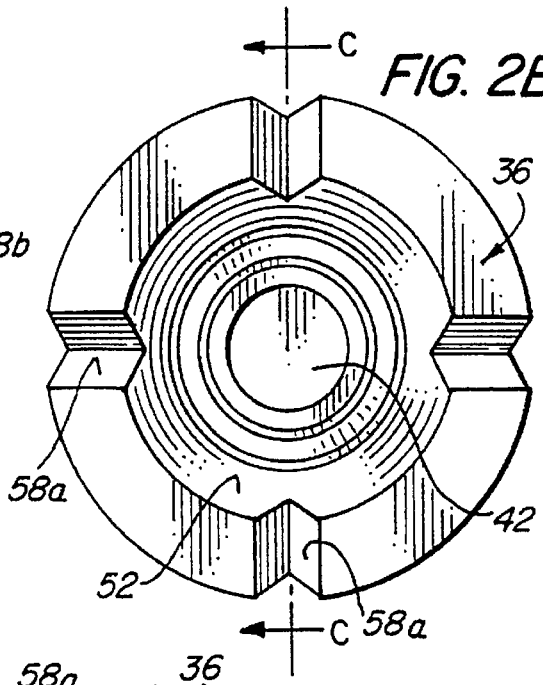
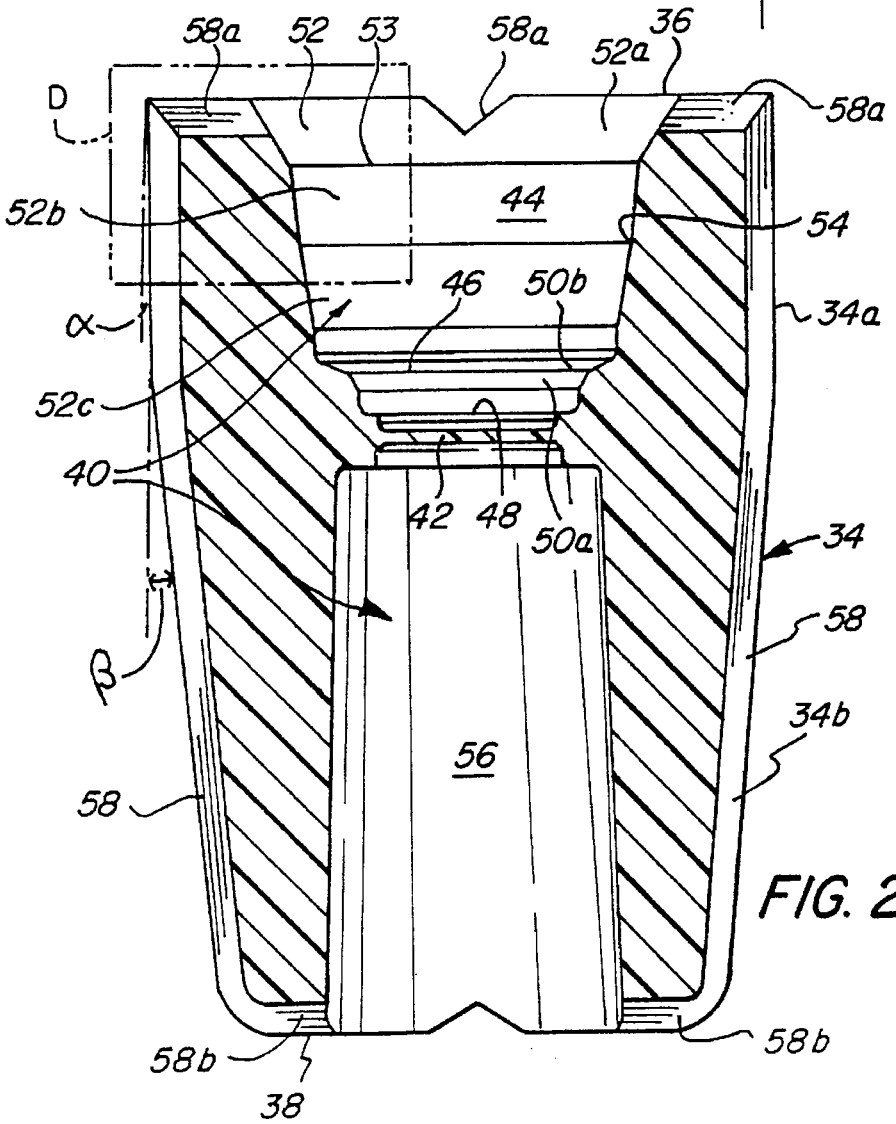
FIG. 2C

UNIVERSAL ISOLATION MEMBER AND NON-ELECTRIC DETONATOR CAP INCLUDING THE SAME

This application is a continuation of application Ser. No. 08/327,200 filed on Oct. 21, 1994, now abandoned.

BACKGROUND OF THE INVENTION

1. Field of the Invention

The present invention concerns an improved isolation member for use in a non-electric detonator cap and an improved detonator cap including the same. More particularly, the present invention concerns an isolation member capable of properly positioning any one of two or more signal transmission lines of different outside diameters within the shell of a detonator cap so as to direct the signal emitted from the signal transmission line at the target, which may be a pyrotechnic or an explosive charge, within the detonator cap.

2. Related Art

The use of isolation members in non-electric detonator caps which are to be assembled to fuses of a type capable of transmitting a static electric charge is known in the art, as shown by U.S. Pat. No. 3,981,240 issued Sep. 21, 1976 to E. L. Gladden. That Patent discloses the use of signal transmission lines, i.e., fuses, of the type disclosed in U.S. Pat. No. 3,590,739 issued Jul. 6, 1971 to P. A. Persson. Such fuses, commonly referred to as "shock tubes", comprise an elongated hollow tube made of one or more synthetic organic polymeric material(s) (plastics) containing on the interior wall thereof a coating of reactive material such as a pulverulent high explosive and reducing agent, for example, PETN or HMX and aluminum powder. The coating of reactive material on the interior wall is quite thin and leaves the tube hollow, providing an open channel or bore extending the length of the tube. When the reactive material is ignited, as by a spark igniter or a detonator cap used as a signal-transmitter, or any other suitable means, ignition of the reactive material propagates an initiation signal through the bore of the tube. If the tube is properly connected to a receptor detonator cap, the initiation signal will initiate detonation of the cap. (As used herein, the "receptor" detonator cap is the cap which is to be detonated by the initiation signal transmitted through the tube or other signal transmission line.)

Other patents concerning such shock tubes and the manufacture thereof include U.S. Pat. No. 4,328,753, issued May 11, 1982 to L. Kristensen et al and U.S. Pat. No. 4,607,573 issued Aug. 26, 1986 to G. R. Thureson et al. As disclosed in the Thureson et al Patent, the reactive material may comprise a thin coating or dusting of a mixture of an explosive such as PETN, RDX, HMX or the like, and a fine aluminum powder, and the shock tube may be a plural-layer tube. For example, as disclosed in the Kristensen et al Patent, the inner tube may comprise a plastic, such as a SURLYN™ ionomer, to which the reactive powder will adhere and the outer tube may be made of a mechanically tougher material such as low or medium density polyethylene. (SURLYN is a trademark of E. I. DuPont de Nemours & Co. for its ionomer resins.)

U.S. Pat. No. 4,757,764 issued Jul. 19, 1988 to G. R. Thureson et al discloses signal transmission lines comprising tubes as described above except that the reactive material is a low velocity deflagrating material instead of an explosive powder of high brisance (e.g., PETN or HMX). Use of a deflagrating material provides a reduced speed of transmission of the initiation signal propagated through the tube as compared to shock tubes. Such deflagrating material tubes are sold under the trademark LVST® by The Ensign-Bickford Company. Numerous deflagrating materials are disclosed in U.S. Pat. No. 4,757,764, including manganese/potassium perchlorate, silicon/red lead, and zirconium/ferric oxide, to name but a few of the many disclosed in that Patent starting at column 3, line 48. As pointed out at column 4, line 47 et seq. of that Patent, LVST® lines transmit an initiation signal by means of a "pressure/flame front" principle whereas shock tubes, when ignited, produce a "shock wave initiation signal" which travels through the tube. Both types of tubes, shock tubes and LVST® lines, as well as detonating cords, especially low-energy detonating cords, may be utilized to initiate detonator caps for use in demolition, mining and other systems. Such tubes and cords are collectively referred to herein and in the claims as "signal transmission lines".

Signal transmission lines of the type comprising a tube containing a metallic powder such as aluminum as part of the reactive material are capable of transmitting a static electric charge which may result in premature detonation of the receptor detonator cap, which can of course have catastrophic results. Accordingly, the invention of the above-mentioned Gladden U.S. Pat. No. 3,981,240 provides a fuse-retaining bushing (28) made of a semi-conductive plastic material. The bushing provides a "stand-off", i.e., a space, between the signal-emitting end of the initiating fuse (26) and the target of the initiation signal which, in the illustrated case, is a primer or booster charge (20). The bushing isolates the signal-emitting end of the signal transmission line from the target by a thin, flat rupturable membrane (40). The bushing further provides a shunt path for transmitting static electric charges from the signal-emitting end of the initiator fuse to the metallic shell or casing (12) of the detonator cap, thereby bleeding off static charges before they reach a potential high enough to cause a spark which could penetrate the diaphragm and ignite the cap charge to prematurely detonate the cap.

SUMMARY OF THE INVENTION

In accordance with the present invention, there is provided an isolation member for positioning the signal-emitting end of a non-electric signal transmission line within the shell of a detonator cap. The isolation member, the body of which may be substantially entirely comprised of a semi-conductive synthetic organic polymeric material, comprises the following components. A substantially cylindrical body is dimensioned and configured to be received within the shell of the detonator cap and has an input end, an output end and an interior passageway extending through the body for transmission therethrough of an initiation signal from the input end to the output end of the body. The interior passageway defines a positioning region at the input end of the body and a discharge port at the output end of the body. The positioning region comprises an entry mouth and a plurality of axially spaced-apart interior shoulders located between the entry mouth and the discharge port, each interior shoulder being of lesser diameter than the preceding interior shoulder as sensed moving from the input end towards the output end of the body, so that the interior shoulders are respectively capable of receiving and seating thereon, at different axial spacings from the discharge port, signal transmission lines of different outside diameters. The interior shoulders may comprise stepped shoulders or sloped shoulders or both, e.g., one stepped and one sloped shoulder or two stepped shoulders.

In another aspect of the present invention, the isolation member further includes a signal-rupturable diaphragm disposed within the interior passageway to isolate the positioning region from the discharge port, the interior shoulders being axially located between the entry mouth and the diaphragm.

In another aspect of the present invention, the interior shoulder closest to the diaphragm is so located that a signal transmission line seated therein is axially spaced from the diaphragm.

Yet another aspect of the present invention provides that the entry mouth be dimensioned and configured to provide an entry shoulder of greater diameter than any of the interior shoulders and to receive and seat on the entry shoulder a signal transmission line of greater outside diameter than those accommodatable by any of the interior shoulders.

Still another aspect of the present invention provides a detonator cap in combination with the isolation member as described above, the detonator cap being connected to a length of non-electric signal transmission line terminating in a signal-emitting end, the signal transmission line having any one of a selected range of outside diameters. The detonator cap comprises the following components. An elongated shell has an open end for receiving the non-electric signal transmission line and an opposite, closed end. A retainer bushing is positioned in the open end of the shell and has a bore extending therethrough for receiving therein a segment of the length of signal transmission line to connect the same to the elongated shell with the signal-emitting end of the transmission line enclosed within the shell. A receptor charge is positioned within the elongated shell and disposed between the bushing and the closed end of the shell and axially spaced from the bushing, and the isolation member is disposed within the elongated shell between the bushing and the receptor charge.

Other aspects of the present invention are set forth in the following description and the drawings.

BRIEF DESCRIPTION OF THE DRAWINGS

FIG. 2A is an end view of output end 38 of the isolation member of FIG. 2;

FIG. 2B is an end view of input end 36 of the isolation member of FIG. 2;

FIG. 2C is a cross-sectional view, enlarged with respect to FIG. 2B, taken along line C—C of FIG. 2B;

DETAILED DESCRIPTION OF THE INVENTION AND PREFERRED EMBODIMENTS THEREOF

Figure 1:
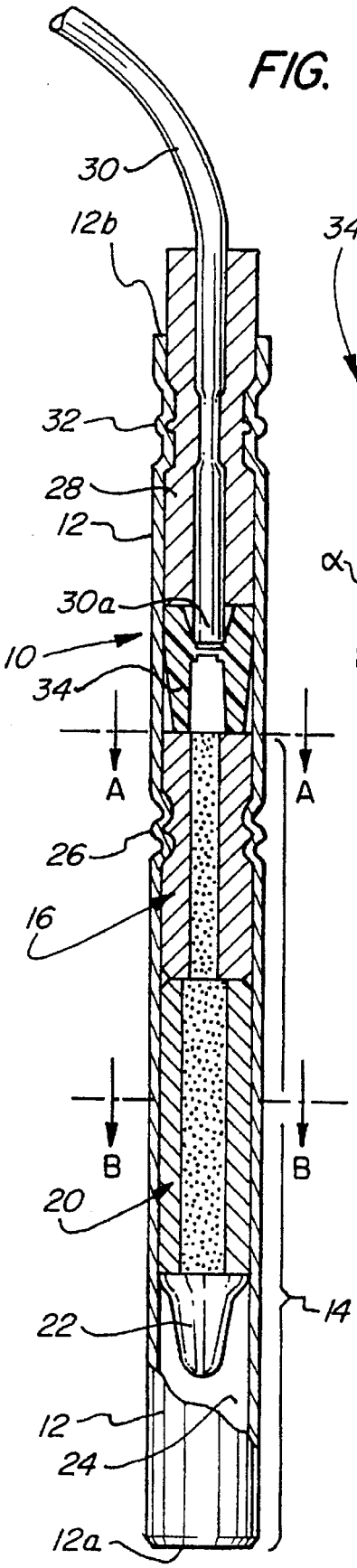
FIG. 1 is a side view, with parts broken away, of a detonator cap having incorporated therein an isolation member in accordance with one embodiment of the present invention.

Referring now to FIG. 1, an embodiment of a receptor detonator cap in accordance with the present invention is generally indicated at 10 and comprises a tubular casing or shell 12 made of a suitable plastic or metal, such as a semi-conductive plastic material or, as in the illustrated embodiment, aluminum. Shell 12 has a closed end 12*a* and an opposite, open end 12*b*. A signal transmission line comprises, in the illustrated embodiment, a shock tube 30 having a signal-emitting end 30*a* which is connected to shell 12 as more fully described below. A receptor charge generally indicated at 14 is enclosed within shell 12 and is comprised of, in the illustrated embodiment, a sealer element 16, a delay element 20, a primary explosive charge 22, e.g., lead azide or DDNP (diazodinitrophenol), and a secondary explosive charge 24, e.g., PETN. As those skilled in the art will appreciate, receptor charge 14 may include more or fewer elements than those illustrated in FIG. 1. Thus, sealer element 16 and delay element 20 may be eliminated so that receptor charge 14 may comprise only one or more explosive charges, such as primary and secondary charges 22, 24, to provide an instantaneous-acting detonator cap. In other instantaneous-acting caps the primary explosive charge 22 is omitted, so that the receptor charge 14 simply comprises the secondary explosive charge 24. In other detonator cap configurations, the receptor charge 14 may comprise, in addition to sealer element 16 and delay element 20, an additional, highly exothermic pyrotechnic element disposed between the sealer element and the delay element in cases where the delay element core is a relatively insensitive composition. This type of arrangement is illustrated in FIG. 1D, wherein parts identical to those of FIG. 1 are identically numbered and the description thereof is not repeated. As shown in FIG. 1D, a detonator cap 10' includes, in addition to the components of detonator cap 10 of FIG. 1, a starter element 18 which comprises a pyrotechnic core 18*a* and a sheath 18*b*. In other known constructions, elements 16, 18 and 20 of FIG. 1D may be replaced by what is referred to as a "rigid element". Such rigid element comprises a unitary sheath which contains in sequence (as sensed moving from open end 12*b* towards closed end 12*a*) a pyrotechnic core, a primary explosive core and a secondary explosive core. Such rigid element may be used in place of sealer element 16, starter element 18 and delay element 20. Alternatively, a sealer element 16 may be deployed adjacent to the rigid element, on the side thereof facing the open end of the detonator. Another known variation is a detonator which contains a delay element 20, but no sealer element 16 or starter element 18. Generally, any known type of detonator construction may be used in connection with the invention. Accordingly, receptor charge 14, which provides the target for the signal (e.g., that emitted from the signal-emitting end 30*a* of shock tube 30) may provide either a pyrotechnic or an explosive charge target.

Figure 1B:
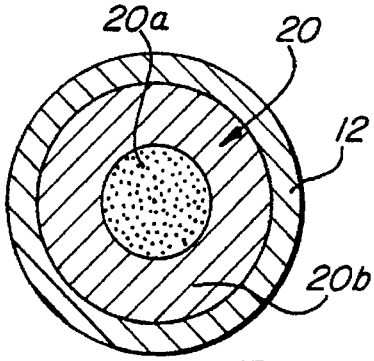
FIGS. 1A and 1B are cross-sectional views, enlarged with respect to FIG. 1, taken along, respectively, lines A—A and B—B of FIG. 1.
Figure 1A:
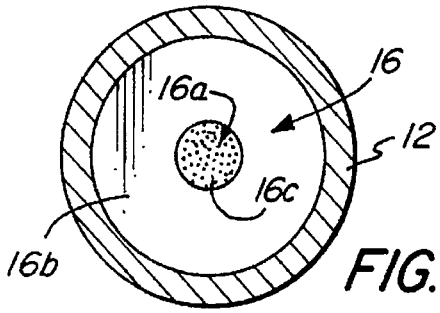

As shown in FIGS. 1A and 1B, the sealer and delay elements 16, 20 each comprises respective pyrotechnic cores 16*a* and 20*a* encased within suitable respective sheaths 16*b* and 20*b*. The sheaths 16*b* and 20*b* conventionally comprise a material such as lead or aluminum which may readily be deformed by pressure or crimping. Thus, a crimp 26 may be formed in shell 12 to slightly deform lead sheath 16*b*, thereby securely sealing and retaining receptor charge 14 positioned within shell 12. Alternatively, the sheath may be pressed after it is placed within the shell, using a press pin. In response to the pressure, the sheath will expand and seal against the inside wall of the shell. In other cases, the sheath may be sized to have an outside diameter which is equal to or slightly larger than the inside diameter of shell 12, to provide an interference fit.

In the illustrated embodiment, receptor charge 14 includes a pyrotechnic train comprised of elements 16 and 20 and an explosive charge comprised of primary and secondary explosive charges 22 and 24, occupies only a portion of the length of shell 12, and is disposed adjacent the closed end 12*a* thereof. The open end 12*b* of shell 12 is fitted with a retainer bushing 28 and receives one end of a length of fuse which may comprise any suitable signal transmission line, e.g., shock tube 30 as illustrated or an LVST® line or a low-energy detonating cord. The signal-emitting end 30*a* of shock tube 30 is enclosed within shell 12. A crimp 32 is formed at or in the vicinity of open end 12*b* of shell 12 in order to grip retainer bushing 28 and shock tube 30 in place and to seal the interior of shell 12 against the environment. Accordingly, retainer bushing 28 is usually made of a resilient material such as a suitable rubber or elastomeric polymer. Shock tube 30 is of conventional construction, comprising a laminated tube having an outer tube 30*b* which may be made of polyethylene, extruded over, or co-extruded with, a sub-tube 30*c* which may be made of a polymer, such as a SURLYN™ ionomer, to which the reactive powder adheres. Alternatively, a monolayer tube may be employed. A dusting 30*d* of reactive powder (greatly exaggerated in thickness in FIG. 1C for clarity of illustration) clings to the inner wall provided by the inside surface of sub-tube 30*c*.

Isolation member 34 is interposed between the signal-emitting end 30*a* of shock tube 30 and the input end of the receptor charge 14 which, in the embodiment of FIG. 1, is the end of sealer element 16 which faces the open end 12*b* of shell 12. As best appreciated with respect to FIG. 1A, the target area which the signal emitted from shock tube 30 must strike and ignite in order for the cap 10 to properly function is, in the illustrated embodiment, the limited area provided by the exposed ignition face end of pyrotechnic core 16*a*. If tube 30 is not aligned along the longitudinal axis of shell 12, for example, if tube 30 is curved at or near the signal-emitting end 30*a* thereof, the signal emitted from signal-emitting end 30*a* may not squarely strike pyrotechnic core 16*a*, but all or part of it may instead strike sheath 16*b*, thereby causing a misfire. Isolation member 34 is designed to prevent such curving of tube 30 and consequent misfiring.

Figure 1C:
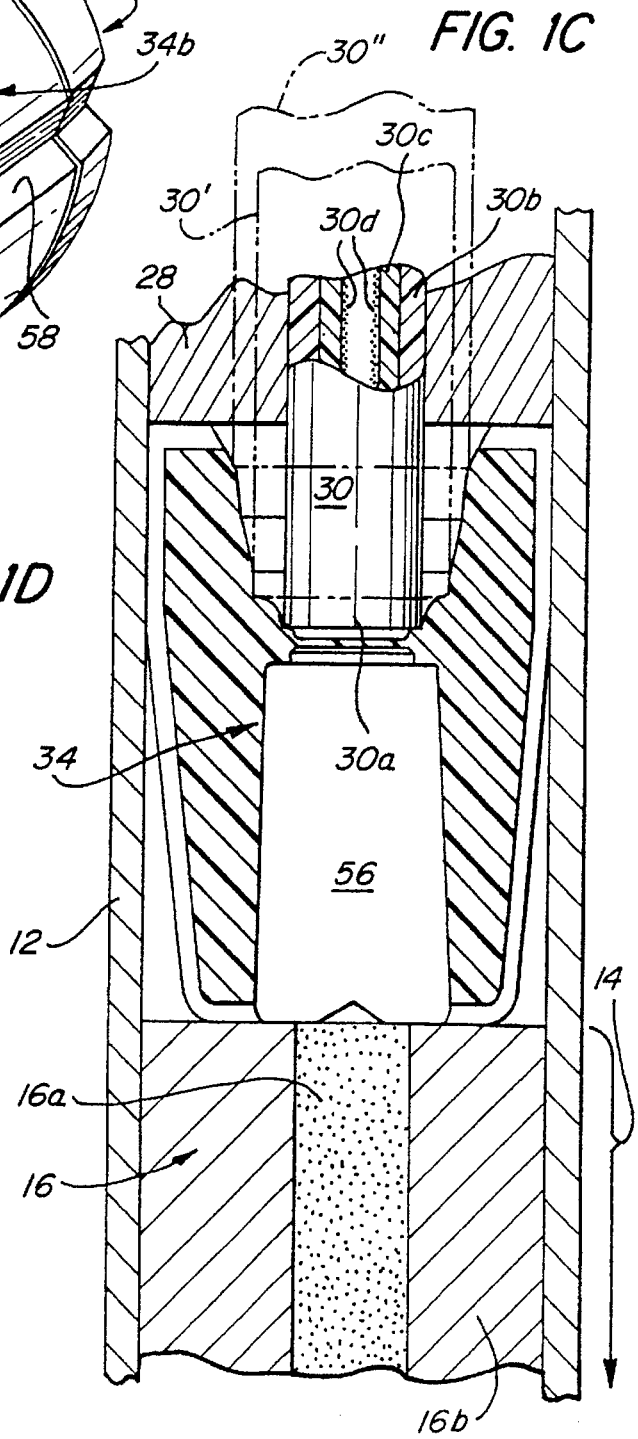
FIG. 1C is an enlarged view of the portion of FIG. 1 containing the isolation member.
Figure 1D:
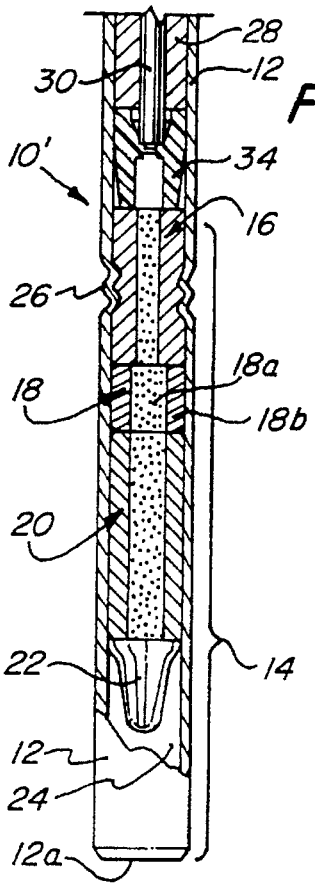
FIG. 1D is a reduced-size (relative to FIG. 1) view of another embodiment of a detonator cap generally corresponding to that of FIG. 1, except that the upper part of the drawing is broken away.

Referring now to FIG. 1C, isolation member 34 is seen to be seated upon the ignition face end of sealer element 16 with discharge port 56 aligned with pyrotechnic core 16*a*. It will be noted that although generally substantially cylindrical in shape, isolation member 34 tapers slightly inwardly in moving from the direction of its input end 36 towards its output end 38. In the illustrated embodiment (FIG. 2C), a first section 34*a* of isolation member 34 has a taper angle $\alpha$ of, e.g., about 1 degree or less, and the longitudinally longer second section 34*b* has a slightly larger taper angle $\beta$ of, e.g., from about 1 to 5 degrees. This dual-tapered configuration facilitates both removing isolation member 34 from the mold in which it is formed and insertion of isolation member 34 into snug-fitting contact, for example, an interference- or force-fit contact with the interior of shell 12. As described above, the taper angle $\alpha$ of the first section 34*a* of isolation member 34 is significantly smaller than the taper angle $\beta$ of the longer, second section 34*b* of isolation member 34. By utilizing this construction, a sufficiently large taper, angle $\beta$, is attained to facilitate mold release and insertion of isolation member 34 into shell 12, while the limited taper at the first section 34*a* minimizes tilting of isolation member 34 out of alignment with the longitudinal center axis of detonator cap 10 after insertion of isolation member 34 into shell 12. The small taper of first section 34*a* provides a region of increased wall contact between isolation member 34 and the interior wall of shell 12, thereby eliminating or at least reducing the tendency of isolation member 34 to tilt out of longitudinal alignment. The length (along the longitudinal axis of member 34) of first section 34*a* may be increased relative to the length of second section 34*b* to facilitate maintaining proper alignment of member 34 within shell 12.

As is known in the art, for example, from the above-mentioned E. L. Gladden U.S. Pat. No. 3,981,240, isolation member 34 may be molded of a semi-conductive synthetic organic polymeric material. Thus, a suitable polymer may have carbon black or other conductive material mixed therein in order to render isolation member 34 electrically semi-conductive. The term "semi-conductive" is used herein in a broad sense. It embraces a range of conductivity which will cause any static electric charge which tends to build up in the interior of shock tube 30 to be conducted from signal-emitting end 30*a* thereof radially through the body of isolation member 34 and be grounded to the metal (or semi-conductive plastic) shell 12 of cap 10 before sufficient potential builds up to cause a spark which would cause ignition of reactive powder 30*d* on the interior wall of shock tube 30 or of dislodged reactive powder accumulated on the signal-rupturable diaphragm 42, or which could penetrate diaphragm 42 and discharge port 56 to prematurely ignite receptor charge 14.

Figure 2D:
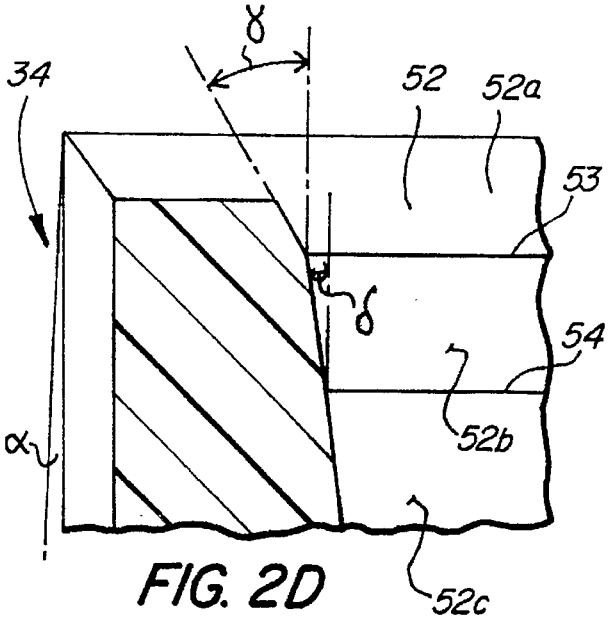
FIG. 2D is a view, enlarged with respect to FIG. 2C, of the portion of FIG. 2C enclosed within the phantom line rectangle of FIG. 2C.
Figure 2:
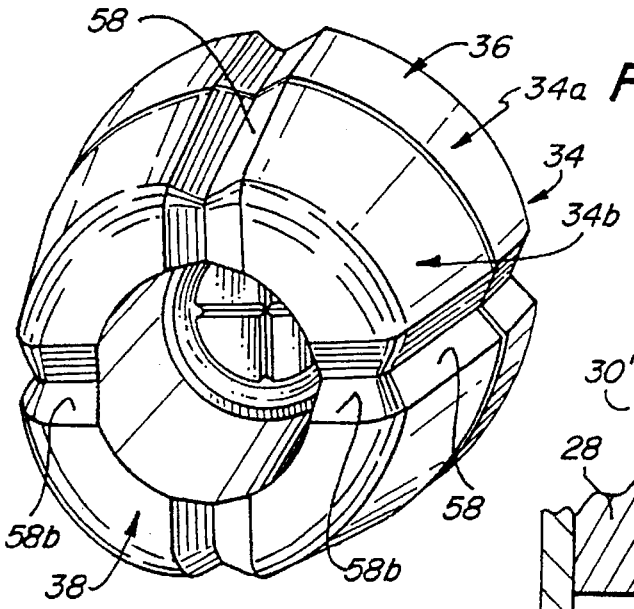
FIG. 2 is a perspective view of the isolation member of FIG. 1.

Referring now to FIGS. 2 to 2C, isolation member 34 is seen to have a substantially cylindrical body and an input end 36 and an output end 38. An interior passageway 40 (FIG. 2C) is comprised of a positioning region 44 which opens to the input end 36 of isolation member 34, and a discharge port 56 which opens to the output end 38 of isolation member 34. Interior passageway 40 is seen to be concentrically disposed about the longitudinal axis of isolation member 34 and extends therethrough from input end 36 to output end 38. A signal-rupturable diaphragm 42 is disposed within interior passageway 40 and separates positioning region 44 from discharge port 56.

Positioning region 44 comprises entry segments 52*a*, 52*b* and 52*c*. Entry segment 52*a* is an initial entry segment which defines the mouth of positioning region 44, entry segment 52*b* is a second entry segment and entry segment 52*c* is a third entry segment. A juncture 53 is formed between segments 52*a* and 52*b* and a juncture 54 is formed between entry segments 52*b* and 52*c*. Entry segment 52*a*, or at least the portion thereof adjacent to juncture 53, serves as an entry shoulder 52 to receive a signal transmission line as described below. A plurality of shoulders (three in the embodiment illustrated in FIG. 2C) comprised of entry shoulder 52 and interior shoulders 46, 48 provide positioning means in the illustrated embodiment of FIGS. 2–2C. Interior shoulders 46 and 48 comprise stepped shoulders and are separated by longitudinally extending chamfers 50*a*, 50*b* which decrease in diameter as sensed moving from input end 36 towards output end 38. (In the following discussion, unspecified references to decreases in diameter are as sensed moving in the direction from input end 36 towards output end 38.) Generally, the diameter of positioning region 44 decreases as sensed progressing from entry segment 52*a* towards shoulder 48.

As shown in FIG. 2D, the wall of initial entry segment 52*a* is formed at a first angle $\gamma$ which is larger (e.g., 15° to 45°) than the second angle $\delta$ (e.g., 2° to 26°) formed by the wall of second entry segment 52*b*. The angles $\gamma$ and $\delta$ are those formed between a cross-sectional segment of the surfaces of the walls and a line parallel to the longitudinal axis of isolation member 34, as illustrated in FIG. 2D. Referring again to FIG. 2C, shoulder 52 may have a diameter of, e.g., from about 0.142 to 0.158 inch (about 3.607 to 4.013 millimeters, "mm").

The decreasing diameter of positioning region 44 from initial entry segment 52*a* to shoulder 48 helps to guide the entry of the end of smaller diameter signal transmission lines (such as shock tube 30 in the embodiment of FIG. 1) into shoulder 46 or shoulder 48. Positioning region 44 continues to decrease in diameter until it joins shoulder 46 which may have a diameter of, e.g., from about 0.124 inch to 0.142 inch (3.149 to 3.607 mm). Shoulder 48 may have a diameter of about 0.092 to 0.104 inch (2.337 to 2.642 mm). Positioning region 44 terminates with shoulder 48, which is preferably dimensioned and configured to engage the end of the smallest diameter input signal transmission line expected to be used with isolation member 34. Thus, shoulder 48 serves to protect diaphragm 42 from being ruptured by the insertion of a signal transmission line during the assembly process.

The signal-rupturable diaphragm 42 isolates the target provided by receptor charge 14 (which in the illustrated embodiment is pyrotechnic core 16*a*), from electrostatic discharge, which is diverted to shell 12 by isolation member 34 as described above, and prevents any dislodged reactive material 30*d* from accumulating on top of the inlet face of pyrotechnic core 16*a*, as is known in the art. The signal emitted from Shock tube 30 by igniting it in normal operation is sufficiently powerful to rupture diaphragm 42 so that the signal extends to the inlet face of pyrotechnic core 16*a*.

Figure 2E:
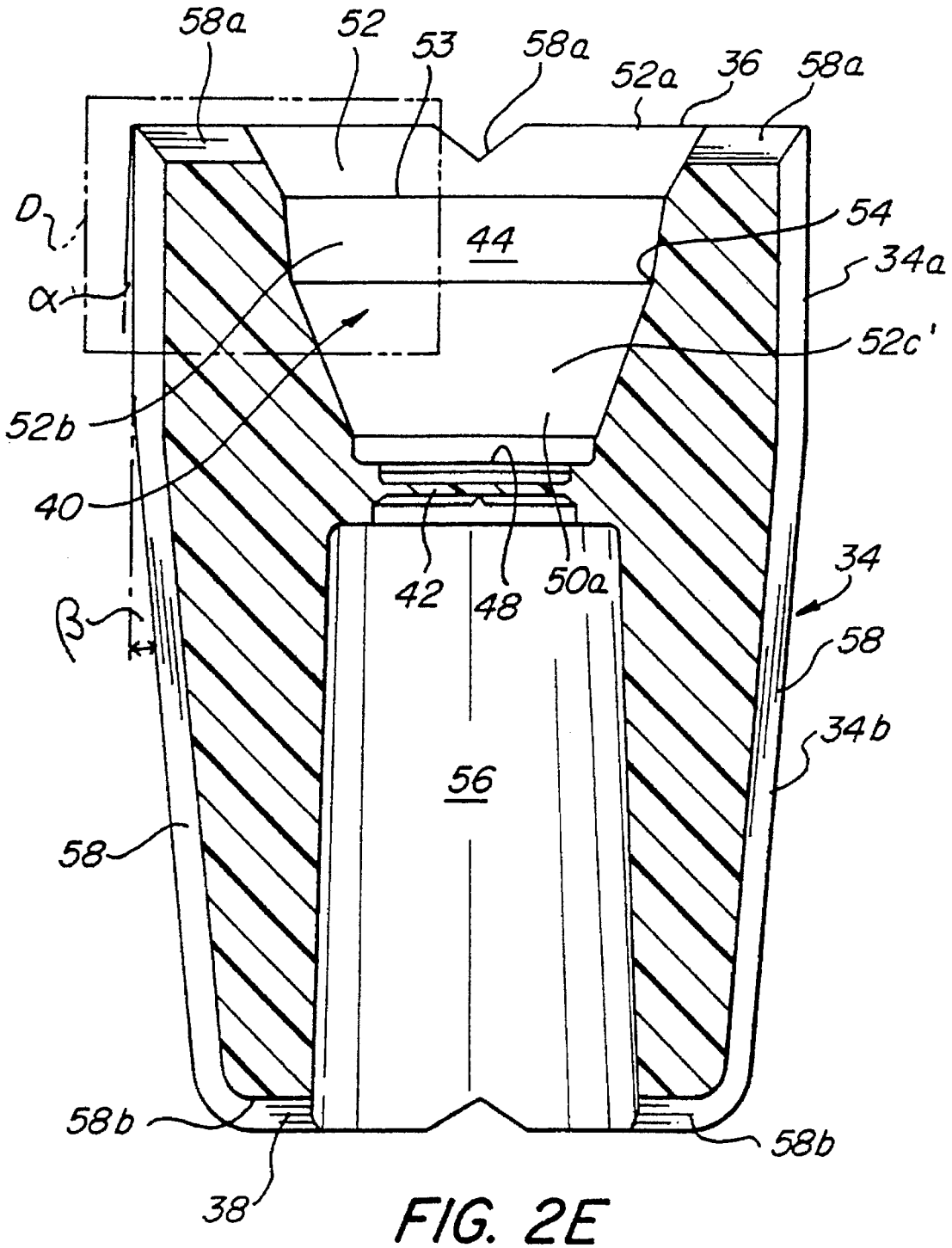
FIG. 2E is a view similar to FIG. 2C of another embodiment of an isolation member in accordance with the present invention.

In an alternative embodiment shown in FIG. 2E as isolation member 34', the positioning means may comprise entry segments 52*a*, 52*b* and 52*c*', and stepped shoulder 48. Those features of the embodiment of FIG. 2E which are substantially or exactly the same as those of FIG. 2C, bear indicator numerals identical to those used in FIG. 2C and are not further described here. Entry segments 52*a*, 52*b* and 52*c*' comprise sloped surfaces of smoothly decreasing radial dimension as sensed moving from input end 36 toward shoulder 48 and output end 38. The sloped surface of segment 52*c*' terminates at the shoulder 48. In this embodiment, respective axial locations on the sloped surfaces of entry segments 52*a* and 52*c*' have diameters equal to the respective outside diameters of two of the signal transmission lines (corresponding to 30" and 30' of FIG. 1C) which can be inserted into the isolation member 34' and therefore entry segments 52*a* and 52*c*' will serve to receive and seat thereon corresponding signal transmission line. A third, smaller diameter signal transmission line (corresponding to 30 of FIG. 1C) can be seated on shoulder 48. Thus, in this embodiment entry segment 52*a* serves as the entry shoulder, entry segment 52*c*' serves as a first interior shoulder and stepped shoulder 48 serves as a second interior shoulder.

There is preferably a difference of at least 0.03 inch (0.76 mm) between the average diameters of entry segments (shoulders) 52*a* and 52*c*' and between 52*c*' and shoulder 48, with the diameter of shoulder 48 being less than that of (shoulder) 52*c*' and the diameter of 52*c*' being less than that of 52*a*. The same minimum diameter difference exists between adjacent ones of the shoulders 52*a*, 46 and 48 of the FIG. 2D embodiment.

In the embodiments of both FIGS. 2D and 2E, interior shoulder 48, the shoulder closest to diaphragm 42, is dimensioned and configured so that a signal transmission tube seated in shoulder 48 (as tube 30 in FIG. 1C) is axially spaced from diaphragm 42. Tubes seated in shoulders axially more remote from diaphragm 42 are obviously axially spaced therefrom an even greater distance.

Generally, reference herein and in the claims (a) to an "entry shoulder" means the shoulder (such as 52*a* of FIGS. 2C and 2E) formed at the mouth or entry of positioning region 44; and (b) to "interior shoulder" or "interior shoulders" (such as 46 and 48 of FIG. 2C or 52*c*' and 48 of FIG. 2E) means shoulders disposed between the entry shoulder and the discharge port 56, i.e., between the entry shoulder and diaphragm 42. Reference herein and in the claims (a) to a "stepped shoulder" means a shoulder such as 46 or 48 wherein the shoulder is substantially L-shaped in profile (as viewed in FIGS. 2C and 2E), being formed at approximately a right angle to the side wall; and (b) to a "sloped shoulder" means a shoulder such as 52*c*' in FIG. 2E formed by a smoothly diminishing radius wall, as sensed moving from the input end 36 to the output end 38 of the body. Thus, in the embodiment of FIG. 2E, entry segment 52*a* is dimensioned and configured to serve as an entry shoulder, segment 52*c*' comprises a sloped interior shoulder and stepped shoulder 48 comprises a second interior shoulder.

The remaining portion of interior passageway 40 is comprised of a discharge port 56 which is separated from positioning region 44 by the diaphragm 42. By centering shock tube 30 in the isolation member, positioning region 44 helps to focus the output signal at the weakest point on the diaphragm 42. Thus, the likelihood that the diaphragm will rupture upon receiving the signal is enhanced. As seen in FIG. 2A, diaphragm 42 has a pair of grooves 42*a*, 42*b* formed therein, which intersect at about the center of diaphragm 42 to facilitate rupturing of the diaphragm 42 by the signal emitted from signal-emitting end 30*a* of shock tube 30. This provides enhanced reliability of operation as more fully described in co-pending patent application Ser. No. 08/327,186, filed Oct. 21, 1994and entitled, "Isolation Member With Improved Static Discharge Barrier and Non-Electric Detonator Cap Including the Same".

As best seen with respect to FIGS. 2, 2A and 2B, isolation member 34 has a plurality (four in the illustrated embodiment) of exterior grooves 58 extending longitudinally along the exterior surface thereof. Grooves 58 extend to include input end radial grooves 58*a* and output end radial grooves 58*b* at the respective opposite ends of each of grooves 58 (FIGS. 2B and 2A, respectively). The use of exterior longitudinal grooves on the outer longitudinal surface of the isolation member is a known expedient in the art to facilitate inserting the isolation member into the shell 12 of cap 10, the fit of a member such as the isolation member 34 in shell 12 being a snug one. The grooves extending longitudinally along the exterior surface provide a flow path for air to escape past the isolation member from the closed end 12*a* of shell 12 as the isolation member is force-fit inserted into the shell, thereby lessening both the resistance to smooth insertion of the isolation member and the possibility of the expelled air rupturing diaphragm 42. The grooves are extended radially around both the input and output ends of the isolation member 34, by the provision of radial grooves 58*a* and 58*b* in the illustrated embodiment, so that a flow path exteriorly of the isolation member 34 is formed between input end 36 and discharge port 56 of the isolation member. This provides a vent flow path to relieve the pressure increase inside the detonator associated with ignition of the shock tube, thereby increasing reliability as discussed in detail in co-pending patent application Ser. No. 08/327,204, filed Oct. 21, 1994, now U.S. Pat. No. 5,501, 151, entitled, "Alternate Signal Path Isolation Member and Non-Electric Detonator Cap Including the Same".

Shock tube 30, which in the illustrated embodiment is a small diameter shock tube, e.g., with an outside diameter of from about 0.080 to 0.090 inch (about 2.032 to 2.286 mm), e.g., about 0.085 inch (about 2.159 mm), is inserted during assembly through retainer bushing 28 and thence into positioning region 44 of isolation member 34, juncture 54 serving to help center shock tube 30 to facilitate seating thereof on shoulder 48 as illustrated. Shock tube 30 is conventionally manufactured by an extrusion process and long lengths of the tube are taken up on reels for storage. After a period of storage, the reels may be used in the manufacture of cap 10, including cutting a length of the shock tube from the reel and securing it to shell 12 in the manner described above and illustrated in FIG. 1. Because the shock tube has been stored for a greater or lesser period of time on a reel it has a tendency to curl, especially those lengths of shock tube which are cut from close to the core of the reel as these have been stored in a very tightly curled configuration. Consequently, there is a tendency, especially with smaller diameter shock tubes, for the inserted end of the shock tube to tend to curl out of alignment and not to be inserted fully within the positioning region of the isolation member 34 and aligned with the longitudinal axis of shell 12. Thus, storage conditions of shock tube (or other signal transmission lines) may result in the shock tube assembled into the detonator cap being curved somewhat at its end so that the signal emitted therefrom is not fired directly along the longitudinal center axis of the cap 10 but is deflected to one side or the other. As best appreciated from FIG. 1A, this may cause the signal to not directly strike the target provided by core **16*a*** but may cause all or part of the signal to strike the sheath surrounding the core, resulting in a misfire. While this tendency is more pronounced with smaller diameter tubes, conventional and even heavy-duty shock tubes, which typically have an outer diameter of 0.150 inch (3.810 mm), are not immune to this condition.

FIG. 1C shows in phantom outline a shock tube 30' of conventional or standard diameter, e.g., having an outside diameter of from about 0.112 to 0.124 inch (about 2.844 to 3.149 mm), e.g., about 0.118 inch (about 2.997 mm), seated within positioning region 44, more specifically, seated within stepped shoulder 46 (FIG. 2C) thereof. Also illustrated in phantom outline in FIG. 1C is a conventional heavy-duty shock tube 30", e.g., having an outside diameter of about 0.135 to 0.165 inch (3.429 to 4.191 mm), e.g., 0.150 inch (3.810 mm), which is seated within positioning region 44, more specifically, within the shoulder 52 (FIG. 2C) thereof. It will be noted that the signal-emitting end of tube 30" (corresponding to end **30*a* of shock tube 30 in FIG. 1C) is, as indicated in phantom outline in FIG. 1C received well within entry segment 52, preferably close to juncture 53, rather than simply being abutted to inlet end 36 of isolation member 34. Shoulder 52 thus comprises a third, entry shoulder, serving the same function for shock tube 30" as stepped shoulders 46 and 48 serve for shock tubes 30' and 30**, respectively.

The standard shock tube 30' and the heavy-duty shock tube 30" have inside diameters appropriate to their increased size, e.g., about 0.045 inch (1.143 mm) in the case of standard shock tube 30' and about 0.051 inch (1.295 mm) in the case of heavy-duty shock tube 30". The inside diameter of a miniaturized shock tube 30 is about 0.030 inch (0.762 mm). The respective inside diameters of the three illustrated sizes of shock tube and their respective loadings of reactive material (reactive powder **30*d* in the case of shock tube 30) are such that the different spacings between the end of receptor charge 14 facing the shock tube and the signal-emitting ends (30*a* in the case of shock tube 30) of the shock tube are appropriate for reliable ignition of receptor charge 14 by the signal emitted from the particular size of shock tube employed. Thus, the shoulders provided to receive and seat the signal-emitting ends of the shock tube effectively define a desired "stand-off" distance between the signal-emitting end of the shock tube and the receptor target 14. The "stand-off" distance is the straight line vertical (as viewed in FIG. 1C) distance between the terminus of the signal-emitting end of the shock tube (30*a* in the case of shock tube 30) and the facing, exposed portion of the receptor charge, more specifically, in the illustrated embodiment of FIG. 1C, the target area provided by the exposed end 16*c* of the pyrotechnic core 16*a*. It will be noted from FIG. 1C that the signal-emitting end 30*a* of shock tube 30 has the smallest stand-off distance and the stand-off distance increases for tube 30' and increases still further for tube 30"**. The stand-off distances are selected to be appropriate for reliable initiation for each of the different sizes of signal transmission tube, e.g., shock tube, which may be utilized. A nominal minimum stand-off is about 0.26 inch (about 6.60 mm). Generally, the range of such stand-off distances is from about 0.260 inch to about 0.385 inch (about 6.604 to 9.779 mm).

As best seen in FIG. 2C, the configuration of the positioning region 44 of isolation member 34, by providing an entry way of generally diminishing cross section as sensed moving from the input end 36 to the output end 38 of isolation member 34, guides the signal-emitting end of the shock tube to help align the signal-emitting end thereof longitudinally along the axis of the cap 10. The different sized shoulders 46, 48 and 52 are dimensioned and configured to accommodate three different sized shock tubes, i.e., shock tube 30, or (shown in phantom outline in FIG. 1C) shock tubes 30' or 30". Thus, a single isolation member 34 may be utilized to securely guide and retain differently sized diameter shock tubes 30, 30', and 30". Obviously, LVST® lines or low-energy detonating cords having different diameters corresponding to those of shock tubes 30, 30' and 30" may also be employed. The resulting alignment and retention of one of the shock tubes 30, 30' or 30" or other signal transmission lines enhances proper striking by the signal emitted from signal-emitting end **30*a* of shock tube 30 of the target area provided by the receptor charge, e.g., by pyrotechnic core 16*a*** in the illustrated embodiment.

In cases where, due to a manufacturing fault, the signal transmission line, e.g., shock tube 30, 30' or 30", is not fully and firmly seated in its associated shoulder 46 (tube 30) or 48 (tube 30') or shoulder 52 (tube 30"), the diminishing diameter configuration of positioning region 44 helps to deflect and direct the initiation signal emitted from the signal transmission line onto the target, thus increasing the probability of a successful ignition of the target, e.g., pyrotechnic core **16*a* of sealer element 16. Thus, the gradually decreasing diameter of positioning region 44 as one moves beyond juncture 54 in the direction of discharge port 56, i.e., in the direction from the input to the output end of isolation member 34, helps to deflect the signal which would emanate from a misaligned signal transmission line towards the longitudinal centerline of the target. For example, if a shock tube were not fully inserted so that the signal-emitting end 30*a* thereof was raised somewhat (as viewed in FIG. 2C) above the associated shoulder 46 or 48, the shock tube might tend to curl towards the side of positioning region 44. However, the generally contracting configuration thereof as sensed in the direction moving towards the target would nonetheless tend to redirect the emitted signal through signal-rupturable diaphragm 42 thence through discharge port 56 onto the target provided, in the illustrated case, by pyrotechnic core 16***a*. The particular configuration of discharge port 56 also facilitates ignition of the target, such as pyrotechnic core 16*a*.

While the invention has been described in detail with respect to specific preferred embodiments thereof, it will be apparent to those skilled in the art that upon a reading and understanding of the foregoing that numerous variations and alterations may be made to the disclosed embodiments which nonetheless lie within the spirit and scope of the invention and the appended claims.

What is claimed is:

1. An isolation member for positioning the signal-emitting end of a non-electric signal transmission line within the shell of a detonator cap comprises:

a substantially cylindrical body dimensioned and configured to be received within the shell of the detonator cap and having an input end, an output end and an interior passageway extending through the body for transmission therethrough of an initiation signal from the input end to the output end of the body, the interior passageway defining a positioning region at the input end of the body and a discharge port at the output end of the body;

wherein the positioning region comprises an entry mouth and a plurality of axially spaced-apart interior shoulders located between the entry mouth and the discharge port including two stepped interior shoulders, each interior shoulder being of lesser diameter than the preceding interior shoulder as sensed moving from the input end towards the output end of the body, so that the interior shoulders are respectively capable of receiving and seating thereon, at different axial spacings from the discharge port, signal transmission lines of different outside diameters.

2. The isolation member of claim 1 further including a signal-rupturable diaphragm disposed within the interior passageway to isolate the positioning region from the discharge port and wherein the interior shoulders are axially located between the entry mouth and the diaphragm.

3. The isolation member of claim 2 wherein the interior shoulder closest to the diaphragm is so located that a signal transmission line seated therein is axially spaced from the diaphragm.

4. The isolation member of claim 1 wherein the entry mouth is dimensioned and configured to provide an entry shoulder of greater diameter than any of the interior shoulders and to receive and seat on the entry shoulder a signal transmission line of greater outside diameter than those accommodatable by any of the interior shoulders.

5. An isolation member for positioning the signal-emitting end of a non-electric signal transmission line within the shell of a detonator cap comprises:

a substantially cylindrical body dimensioned and configured to be received within the shell of the detonator cap and having an input end, an output end and an interior passageway extending through the body for transmission therethrough of an initiation signal from the input end to the output end of the body, the interior passageway defining a positioning region at the input end of the body and a discharge port at .the output end of the body;

wherein the positioning region comprises an entry mouth and a plurality of axially spaced-apart interior shoulders located between the entry mouth and the discharge port, each interior shoulder being of lesser diameter than the preceding interior shoulder as sensed moving from the input end towards the output end of the body, so that the interior shoulders are respectively capable of receiving and seating thereon, at different axial spacings from the discharge port, signal transmission lines of different outside diameters; and having interior shoulders comprising a first interior shoulder dimensioned and configured to seat therein a signal transmission line having an outside diameter of from about 0.080 to 0.090 inch (about 2.032 to 2.286 mm) and a second interior shoulder dimensioned and configured to seat therein a signal transmission line having an outside diameter of from about 0.112 to 0.124 inch (about 2.845 to 3.150 mm).

6. The isolation member of claim 1 or claim 5 comprising two interior shoulders that differ in average diameter by at least about 0.03 inch (about 0.76 mm).

7. The isolation member of claim 5 wherein at least one of the interior shoulders comprises a sloped shoulder.

8. The isolation member of claim 5 wherein the interior shoulders are all stepped shoulders.

9. The isolation member of claim 5 comprising two interior shoulders.

10. The isolation member of claim 1 or claim 5 wherein the entry mouth is dimensioned and configured to provide an entry shoulder of a size to seat therein a signal transmission line having an outside diameter of from about 0.135 to 0.165 inch (about 3.429 to 4.191 mm).

11. The isolation member of claim 1 or claim 5 substantially entirely comprised of a semi-conductive synthetic organic polymeric material.

12. A detonator cap connected to a length of non-electric signal transmission line terminating in a signal-emitting end, the signal transmission line having an outside diameter dimensioned to be seated upon one of a plurality of shoulders defined below and the detonator cap comprising:

an elongated shell having an open end for receiving the non-electric signal transmission line and an opposite, closed end;

a retainer bushing positioned in the open end of the shell and having a bore extending therethrough for receiving therein a segment of the length of signal transmission line to connect the same to the elongated shell with the signal-emitting end of the transmission line enclosed within the shell;

a receptor charge positioned within the elongated shell and disposed between the bushing and the closed end of the shell and axially spaced from the bushing; and an isolation member is disposed within the elongated shell between the bushing and the receptor charge, the isolation member comprising a substantially cylindrical body dimensioned and configured to be received within the shell of the detonator cap and having an input end, an output end and an interior passageway extending through the body for transmission therethrough of an initiation signal from the input end to the output end of the body, the interior passageway defining a positioning region at the input end of the body and a discharge port at the output end of the body;

wherein the positioning region comprises an entry mouth and a plurality of axially spaced-apart interior shoulders located between the entry mouth and the discharge port including two stepped interior shoulders, each interior shoulder being of lesser diameter than the preceding interior shoulder as sensed moving from the input end towards the output end of the body, so that the interior shoulders are respectively capable of receiving and seating thereon, at different axial spacings from the discharge port, signal transmission lines of different outside diameters; and wherein the signal-emitting end of the signal transmission line is seated upon a shoulder of the isolation member.

13. The detonator cap of claim 12 wherein the isolation member includes a signal-rupturable diaphragm disposed within the interior passageway to isolate the positioning region from the discharge port and wherein the interior shoulders are axially located between the entry mouth and the diaphragm.

14. The detonator cap of claim 12 wherein the interior shoulder of the isolation member closest to the diaphragm is so located that a signal transmission line seated therein is axially spaced from the diaphragm.

15. The detonator cap of claim 12 wherein the entry mouth of the isolation member is dimensioned and configured to provide an entry shoulder of greater diameter than any of the interior shoulders and to receive and seat on the entry shoulder a signal transmission line of greater outside diameter than those accommodatable by any of the interior shoulders.

16. A detonator cap connected to a length of non-electric signal transmission line terminating in a signal-emitting end, the signal transmission line having an outside diameter dimensioned to be seated upon one of a plurality of shoulders defined below and the detonator cap comprising:

an elongated shell having an open end for receiving the non-electric signal transmission line and an opposite, closed end;

a retainer bushing positioned in the open end of the shell and having a bore extending therethrough for receiving therein a segment of the length of signal transmission line to connect the same to the elongated shell with the signal-emitting end of the transmission line enclosed within the shell;

a receptor charge positioned within the elongated shell and disposed between the bushing and the closed end of the shell and axially spaced from the bushing; and an isolation member is disposed within the elongated shell between the bushing and the receptor charge, the isolation member comprising a substantially cylindrical body dimensioned and configured to be received within the shell of the detonator cap and having an input end, an output end and an interior passageway extending through the body for transmission therethrough of an initiation signal from the input end to the output end of the body, the interior passageway defining a positioning region at the input end of the body and a discharge port at the output end of the body;

wherein the positioning region comprises an entry mouth and a plurality of axially spaced-apart interior shoulders located between the entry mouth and the discharge port, each interior shoulder being of lesser diameter than the preceding interior shoulder as sensed moving from the input end towards the output end of the body, so that the interior shoulders are respectively capable of receiving and seating thereon, at different axial spacings from the discharge port, signal transmission lines of different outside diameters; and wherein the signal-emitting end of the signal transmission line is seated upon a shoulder of the isolation member;

wherein the isolation member has interior shoulders comprising a first interior shoulder dimensioned and configured to seat therein a signal transmission line having an outside diameter of from about 0.080 to 0.090 inch (about 2.032 to 2.286 mm) and a second interior shoulder dimensioned and configured to seat therein a signal transmission line having an outside diameter of from about 0.112 to 0.124 inch (about 2.845 to 3.150 mm).

17. The detonator cap of claim 12 or claim 16 comprising two interior shoulders that differ in average diameter by at least about 0.03 inch (about 0.76 mm).

18. The detonator cap of claim 16 wherein at least one of the interior shoulders of the isolation member comprises a sloped shoulder.

19. The detonator cap of claim 16 wherein the interior shoulders of the isolation member are all stepped shoulders.

20. The detonator cap of claim 16 wherein the isolation member comprises two interior shoulders.

21. The detonator cap of claim 12 or claim 16 wherein the entry mouth of the isolation member is dimensioned and configured to provide an entry shoulder of a size to seat therein a signal transmission line having an outside diameter of from about 0.135 to 0.165 inch (about 3.429 to 4.191 mm).

22. The detonator cap of claim 12 or claim 16 wherein the isolation member is substantially entirely comprised of a semi-conductive synthetic organic polymeric material.

* * * * *